US006976413B2

(12) United States Patent
Hsieh

(10) Patent No.: US 6,976,413 B2
(45) **Date of Patent: *Dec. 20, 2005**

(54) HAND TOOL HANDLE WITH ROTARY CAP

(76) Inventor: Chih-Ching Hsieh, No. 367-1, Pei Yang Road, Feng Yuan, Taichung Hsien (TW)

( * ) Notice: Subject to any disclaimer, the term of this patent is extended or adjusted under 35 U.S.C. 154(b) by 0 days.

This patent is subject to a terminal disclaimer.

(21) Appl. No.: 10/299,715

(22) Filed: Nov. 20, 2002

(65) Prior Publication Data

US 2004/0094002 A1 May 20, 2004

(51) Int. Cl.[7] ..... B25G 1/00
(52) U.S. Cl. ..... 81/492; 81/436; 81/177.1; 16/430
(58) Field of Search . 81/492, 436, 177.1; 16/430–434; 384/243–246

(56) References Cited

U.S. PATENT DOCUMENTS 392,957 A * 11/1888 Latulip ..... 81/492
687,401 A * 11/1901 Morse ..... 81/177.1
1,666,839 A * 5/1928 Cureton ..... 384/243
1,683,484 A * 9/1928 Post ..... 81/177.1
1,816,359 A * 7/1931 Carlin ..... 81/436
2,351,705 A * 6/1944 Prall ..... 81/436
2,564,356 A * 6/1951 Dianda ..... 81/61
2,743,749 A * 5/1956 Lowry ..... 81/177.1
2,849,041 A * 8/1958 Vetri ..... 81/177.1
3,020,104 A * 2/1962 Nichols ..... 384/246
4,093,008 A * 6/1978 Martin ..... 81/177.1
5,823,078 A * 10/1998 Liu ..... 81/492

* cited by examiner

*Primary Examiner*—Hadi Shakeri

(57) ABSTRACT

Hand tool handle with rotary cap, including: a handle having a seat section at rear end; a rotary cap having a cavity and rotatably disposed on the seat section with the seat section accommodated in the cavity; and at least one projection having a cross-sectional area smaller than that of the rotary cap or the rear end of the handle. The projection is positioned between top wall of the cavity and an end face of the seat section. The top wall of the cavity via the projection contacts with the end face of the seat section. When the rotary cap rotates on the handle, the projection serves as a support point for the rotary cap so as to facilitate rotation of the rotary cap.

3 Claims, 7 Drawing Sheets

HAND TOOL HANDLE WITH ROTARY CAP

BACKGROUND OF THE INVENTION

The present invention is related to a hand tool, and more particularly to a hand tool handle having a rotary cap at rear end. The rotary cap has little rotational resistance and is easy to rotate.

When operating a conventional screwdriver, a user's hand must repeatedly turn back and forth so as to one-way rotate the handle. After clockwise rotating the screwdriver, the user's hand must release the handle and move back and then tightly hold the handle to clockwise turn the handle again. Such operation is inconvenient for the user.

FIG. 1 shows a conventional screwdriver 10 in which a rotary cap 14 is rotatably disposed at rear end of the handle 12. When a user operates the screwdriver and the user's hand turns back, the palm keeps in contact with the rotary cap without totally separating from the handle. Therefore, the operation is facilitated. Moreover, when the hand turns back, the screwdriver will not deflect or detach from the screw.

By means of the rotary cap 14, when the hand and the rotary cap turn back, the handle keeps still. However, in the conventional structure, the inner wall of the rotary cap 14 contacts with the rear end face of the handle 12 face to face as shown by notation A. This leads to great frictional resistance so that the rotary cap can be hardly smoothly rotated. When the user's hand turns back, the frictional force between the handle and the rotary cap often makes the screwdriver driven by the rotary cap to synchronously turn back. Therefore, the expected effect can be hardly achieved.

SUMMARY OF THE INVENTION

It is therefore a primary object of the present invention to provide a hand tool handle having with rotary cap. The rotary cap has little rotational resistance and is easy to rotate so as to facilitate the operation.

The present invention can be best understood through the following description and accompanying drawings wherein:

DETAILED DESCRIPTION OF THE PREFERRED EMBODIMENTS

Figure 1:
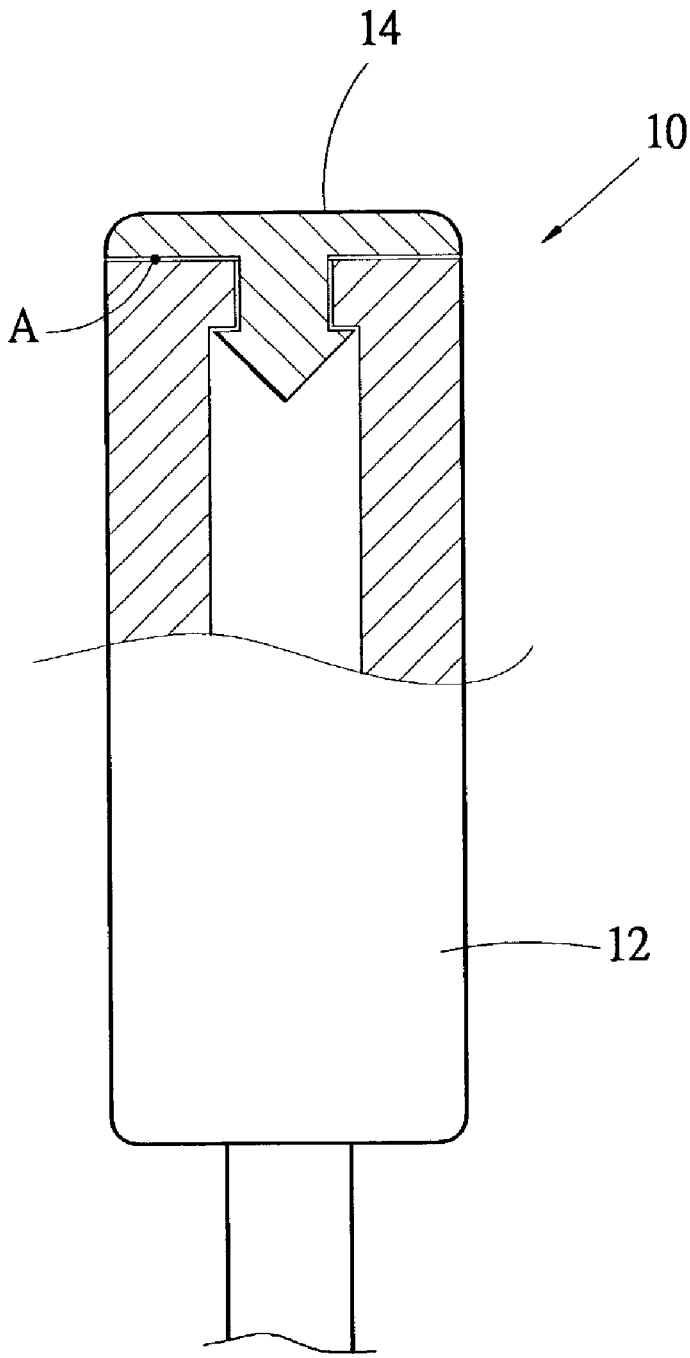
Fig. 1 PRIOR ART
FIG. 1 is a front partially sectional view of a conventional screwdriver.
Figure 2:
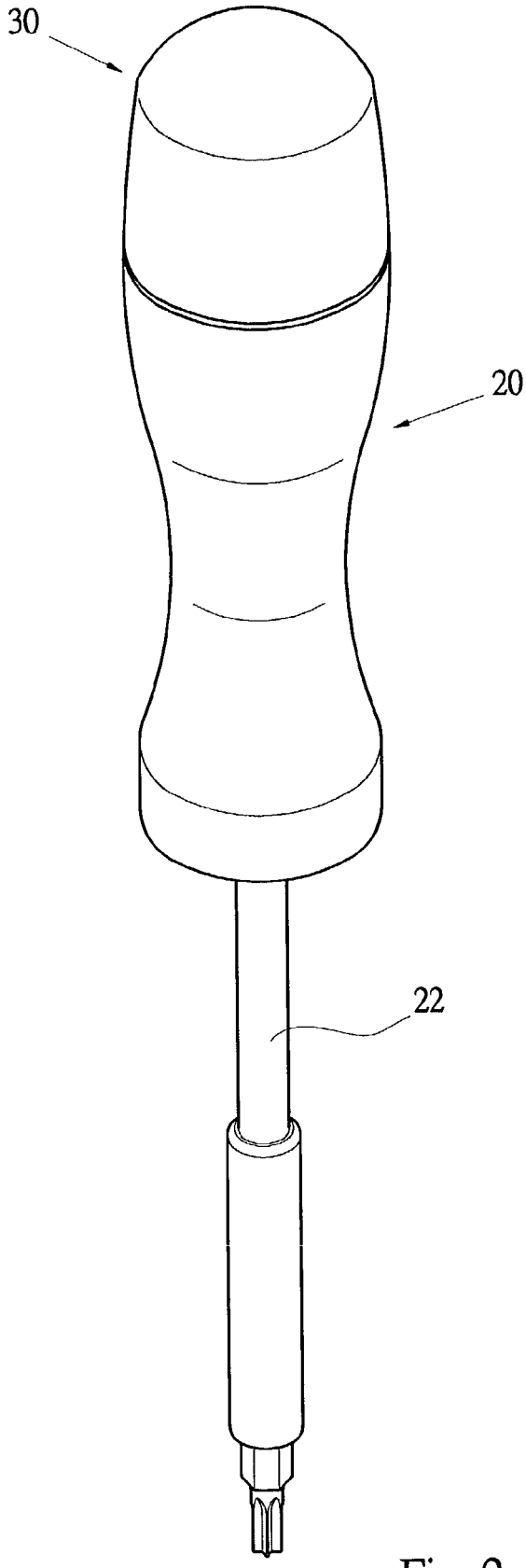
FIG. 2 is a perspective assembled view of a preferred embodiment of the present invention.
Figure 3:
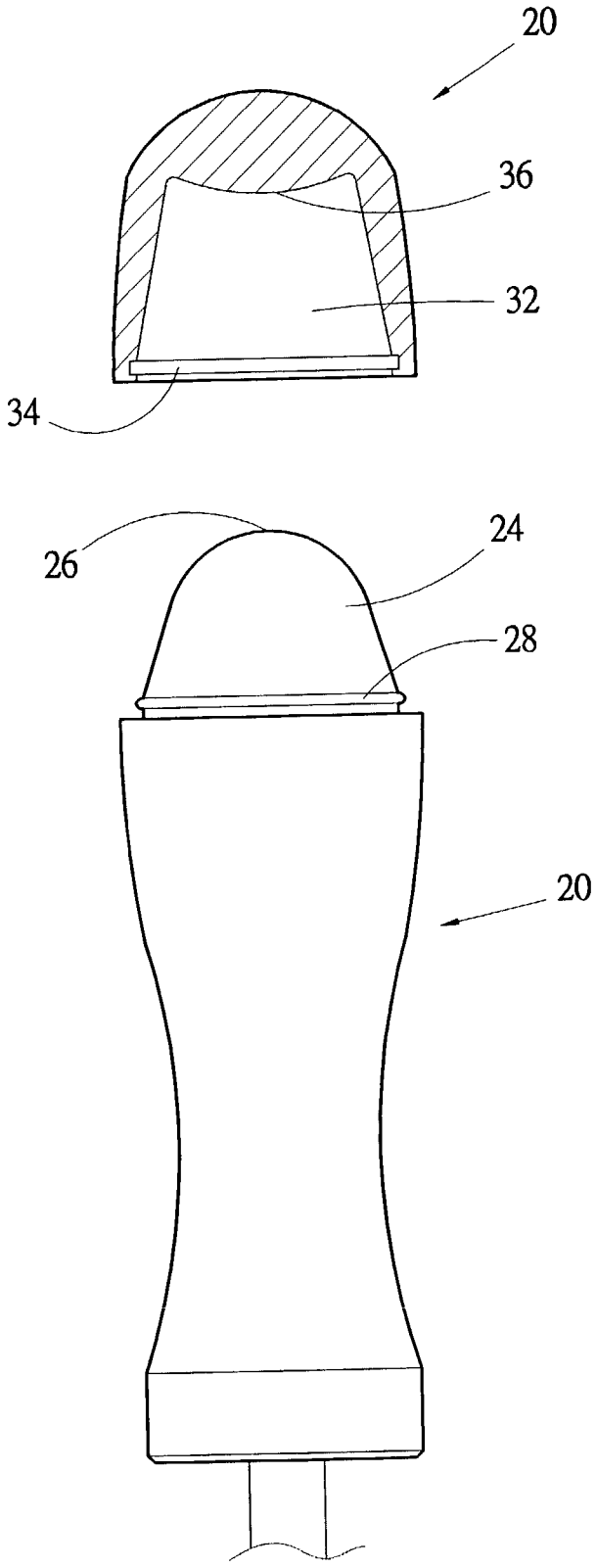
FIG. 3 is a front partially sectional exploded view of the preferred embodiment of the present invention.

Please refer to FIGS. 2 and 3. In a preferred embodiment of the present invention, a handle 20 of a screwdriver is exemplified.

A stem 22 is disposed at front end of the handle 20 for driving a screw or a bolt.

The rotary cap 30 is rotatably disposed at rear end of the handle 20. The inner face of the top of the rotary cap contacts with the rear end of the handle by small area, whereby the rotary cap is better rotatable.

The rear end of the handle 20 is formed with a seat section 24. An engagement section 28 which is an annular rib is formed on the circumference of the seat section 24.

Figure 4:
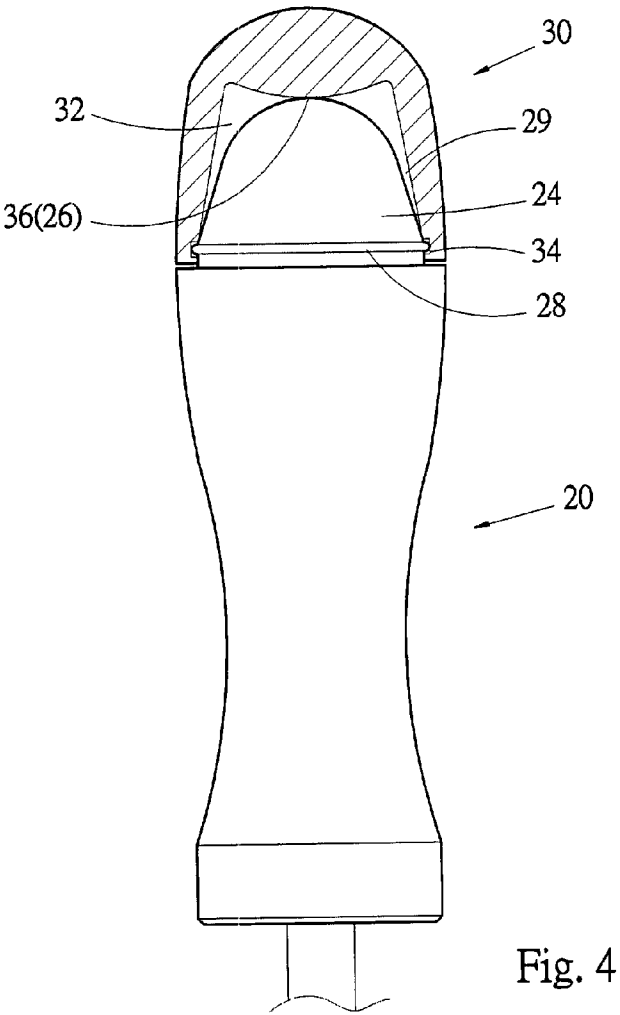
FIG. 4 is a partially sectional assembled view of the preferred embodiment of the present invention.

The rotary cap 30 has a circular cavity 32 inward extending from a bottom end of the rotary cap 30. An engagement section 34 which is an annular groove is formed on an lower inner wall of the rotary cap 30. The engagement section 34 of the rotary cap 30 is engaged with the engagement section 28 of the handle as shown in FIG. 4, whereby the rotary cap 30 is rotatably fitted on the seat section 24 of the handle 20 without easy detachment. In this embodiment, a diameter of the seat section 24 and an inner diameter of the cavity 30 are tapered. A gap 29 is defined between the seat section 24 and the wall of the cavity 32 so that an inner wall of the rotary cap 32 is preferably not in contact with the seat section 24.

The present invention includes at least one projection. In this embodiment, the projection is a convex (or spherical) face 26 formed on an end face of the seat section 24. In addition, a bottom wall of the rotary cap 30 is formed with a convex (or spherical) face 36. When the rotary cap 30 is rotatably disposed at the rear end of the handle, the centers of the two convex faces 26, 36 contact with each other by small area as shown in FIG. 4. The contact area is much smaller than the cross-sectional area of the rotary cap 30 and the handle 20.

In use, a user holds and turns the handle 20 in a direction (for example, clockwise). After turned by a certain angle, the user's hand can loosen the handle and turn back in a reverse direction (for example, counterclockwise). During turning back, the palm can attach to the rotary cap 30 which serves as a fulcrum, whereby the hand and the rotary cap can turn synchronously with the handle keeping still. After turning back by a certain angle, the user again holds the handle and turns the screwdriver.

When the rotary cap 30 is turned, the contact points of the two convex faces 26, 36 serve as the support point and fulcrum of the rotary cap on the handle 20. The contact area is small so that the frictional resistance against the rotary cap is little. Accordingly, the rotary cap can be smoothly rotated. The annular rib 28 and the annular groove 34 are not tightly engaged with each other so as to prevent the rotary cap from detaching from the seat section without affecting the rotation of the rotary cap.

Figure 5:
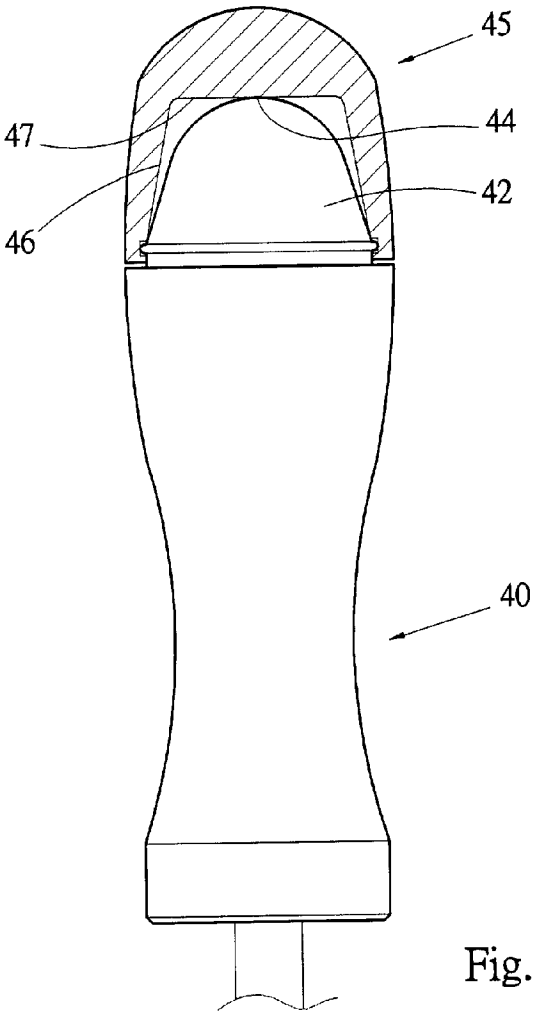
FIG. 5 is a front partially sectional view of another embodiment of the present invention.

FIG. 5 shows another embodiment of the present invention, in which a seat section 42 is also formed at rear end of the handle 40. A rotary cap 45 is freely rotatably disposed on the seat section. The engagement structure of the rotary cap is identical to the above embodiment and will not be further described hereafter. In this embodiment, the projection is a convex face 44 formed on the end face of the seat section 42. The inner face 47 of at an upper side of the wall the rotary cap 45 is a plane face in contact with the convex face 44. When the rotary cap is rotatably disposed at the rear end of the handle, the contact point between the inner face 47 and the convex face 44 serves as the fulcrum and the convex face 44 contacts with the plane face 47 by small area.

Figure 6:
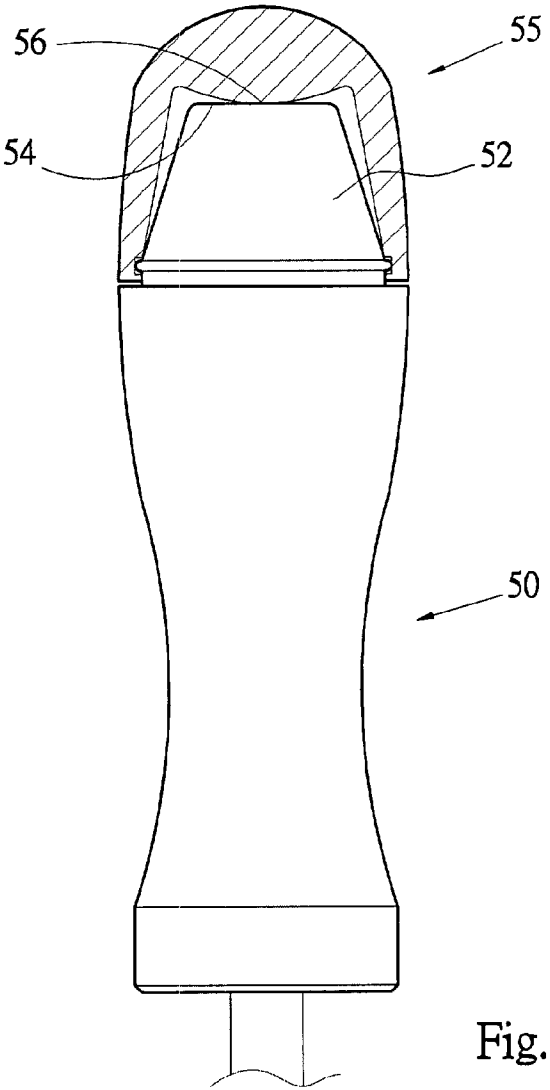
FIG. 6 is a partially sectional view of still another embodiment of the present invention.

FIG. 6 shows still another embodiment of the present invention, in which the end face of the seat section 52 is a plane face 54, while the inner face of the top wall of the rotary cap 55 is a convex face 56 in contact with the plane face 54. The contact point between the plane face 54 and the convex face 56 also serves as the fulcrum and forced portion.

Figure 7:
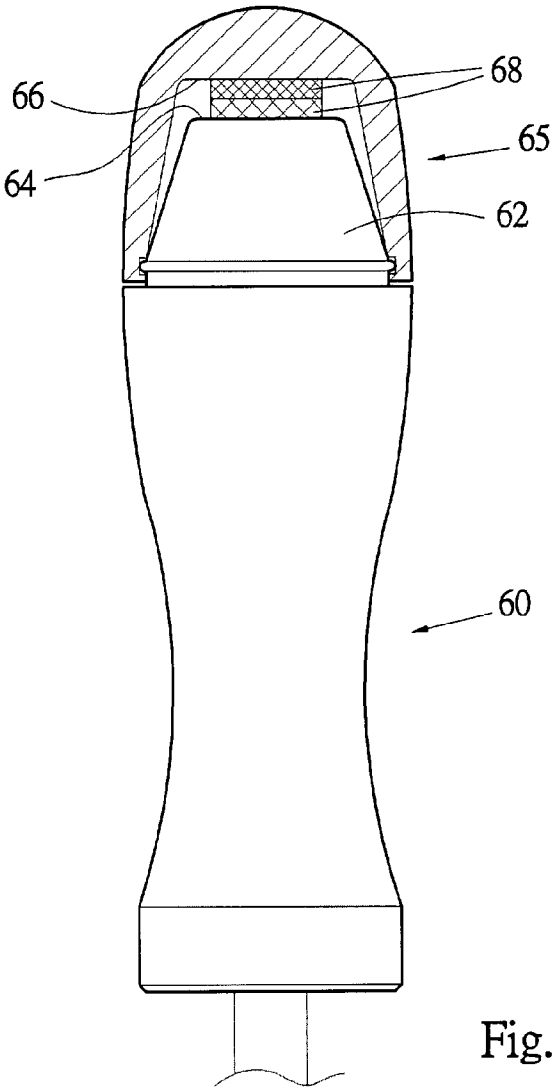
FIG. 7 is a partially sectional view of still another embodiment of the present invention.

FIG. 7 shows still another embodiment of the present invention, in which the end face of the seat section 62 is a plane face 64, and the inner face of the top wall of the rotary cap 65 is also a plane face 66 spaced from the plane face 64 by a certain distance. The projections are two hard pads 68 respectively fixedly disposed on the end face 64 and the inner face 66 in contact with each other. The pads 68 are preferably made of anti-wear material for reducing frictional force.

When the rotary cap 65 is rotated on the handle 60, the contact point between the pads 68 serves as the fulcrum and support portion. The pads contact with each other by small area which much smaller than the cross-sectional area of the handle and the rotary cap so that the rotary cap can be smoothly rotated.

It should be noted that the number of the pads 68 is not limited to two. Alternatively, there can be only one pad fixedly disposed on the end face of the seat section or the top wall of the cavity.

Figure 8:
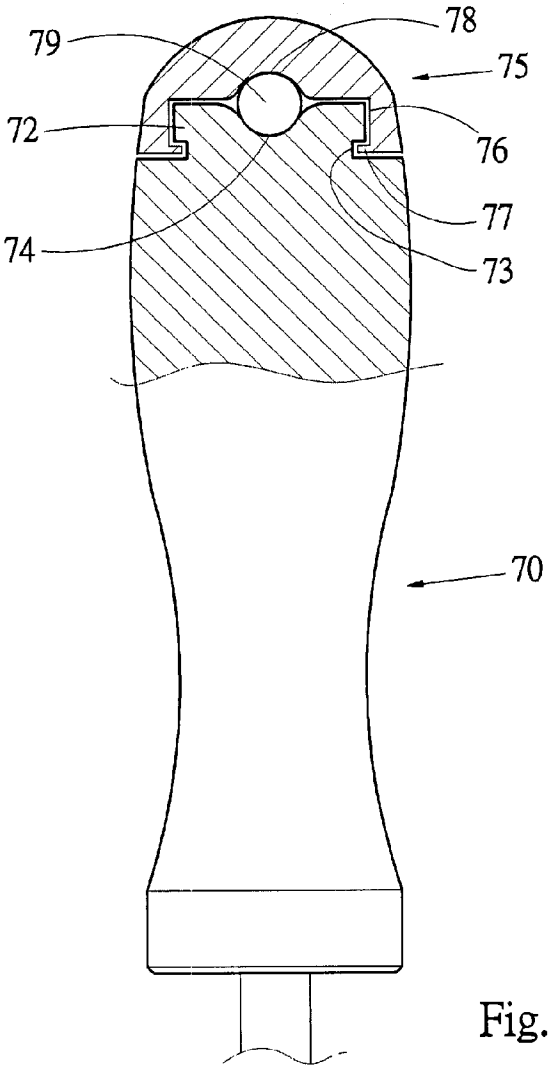
FIG. 8 is a partially sectional view of still another embodiment of the present invention.

FIG. 8 shows still another embodiment of the handle 70 of the present invention, in which a engagement section 77 which is an annular rib is formed on the circumferential wall of the cavity 76 of the rotary cap 75, while a engagement section 73 which is an annular groove is formed on the outer circumference of the seat section 72. The engagement section 77 is engaged with the engagement section 73 to rotatably connect the rotary cap 75 with the handle 70. The projection is a ball body 79 positioned between the end face of the seat section and the top wall of the cavity. Speaking in more detail, the end face of the seat section and an inner bottom wall of the cavity are respectively formed with two dents 74, 78 corresponding to each other. The ball body 79 is placed in the dents 74, 78.

As shown in FIG. 8, the ball body 79 serves as the contact point between the rotary cap 75 and the seat section 72. When the rotary cap rotates on the seat section, the ball body 79 serves as the fulcrum and rolls, whereby the rotary cap suffers little frictional force.

Figure 9:
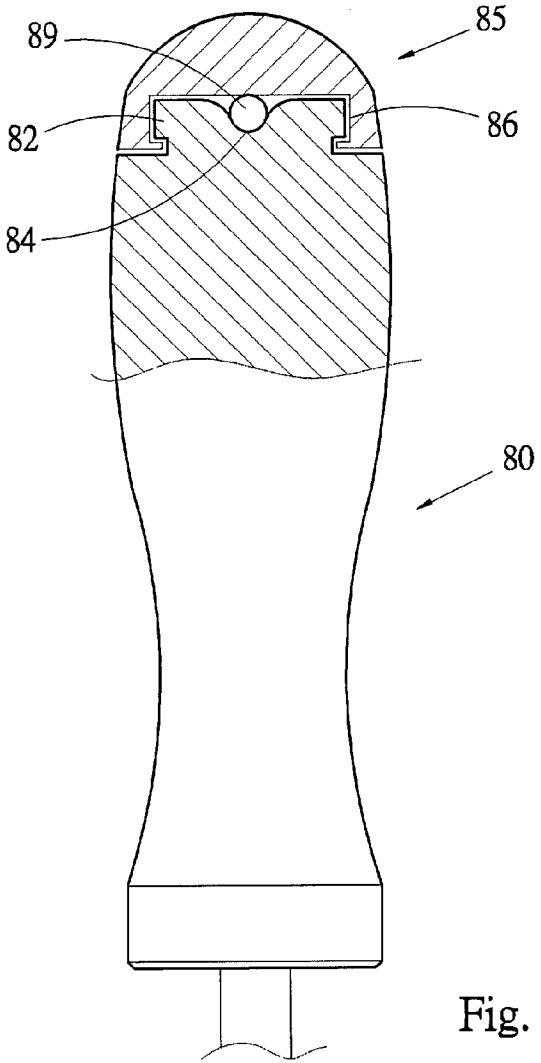
FIG. 9 is a partially sectional view of still another embodiment of the present invention.
Figure 10:
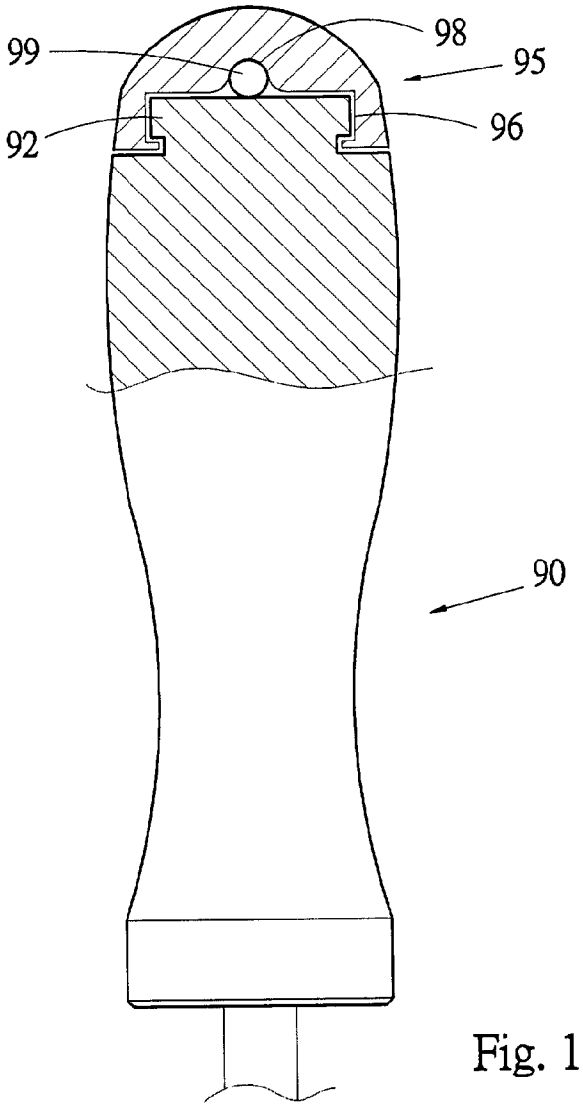
FIG. 10 is a partially sectional view of still another embodiment of the present invention.

FIGS. 9 and 10 show two other embodiments of the present invention, which are similar to the embodiment of FIG. 8. In FIG. 9, the end face of the seat section 82 is formed with a dent 84, while the top wall of the cavity 86 of the rotary cap 85 is a plane face. The ball body 89 is positioned in the dent 84 in contact with the inner bottom wall of the rotary cap 86. In FIG. 10, the end face of the seat section 92 is a plane face, while the top wall of the cavity 96 is formed with a dent 98. The ball body 99 is placed in the dent 98 in contact with the end face of the seat section 92. In these two embodiments, the ball body serves as the support point for the rotary cap 75. The contact area is small and the frictional force is low.

It should be noted that there can be more than one ball body.

In conclusion, the rotary cap contacts with the rear end of the handle by small area. The contact portion serves as the support portion for the rotary cap during rotation. Accordingly, the frictional force against the rotary cap during rotation is effectively lowered so that the rotary cap can be more easily rotated. When a user operates the screwdriver and the user's hand turns back, the palm keeps in contact with the rotary cap without totally separating from the handle. At this time, the handle keeps still without being driven by the rotary cap. Therefore, the operation is facilitated.

The above embodiments are only used to illustrate the present invention, not intended to limit the scope thereof. Many modifications of the above embodiments can be made without departing from the spirit of the present invention.

What is claimed is:

1. A hard tool handle with rotary cap, comprising:

a handle;

a seat section having a convex cambered shape and protruded from a rear end of the handle;

an integral formed rotary cap rotatably disposed at the rear end of the handle, an inner side of the rotary cap being formed with a cavity; an inner bottom wall of the rotary cap being a convex cambered surface and an outer top end of the rotary cap being a convex cambered surface so that the contact area between the inner bottom wall of the rotary cap and the seat section being smaller than a cross-sectional area of the rotary cap or the rear end of the handle, and a gap being formed between the rotary cap and the seat section;

wherein a size of the rotary cap is greater than a size of the seat section; the rotary cap enclosing and receiving the seat section, but no portion of the seat section being enclosing any portion of the rotary cap; and a top end of the convex cambered shape of the seat section is in contact with an inner bottom of the cavity of the rotary cap, and no portion of the handle enclosing the rotary cap and no portion of the rotary cap enclosing the handle;

whereby when the rotary cap rotates on the handle, the seat section serves as a support point for the rotary cap.

2. A hand tool handle as claimed in claim 1, wherein an engagement section is formed on a circumference of the seat section, while another engagement section is formed on an inner lower side of the rotary cap, the engagement sections being engaged with each other.

3. A hand tool handle as claimed in claim 2, wherein the engagement sections are selected from one of an annular rib and an annular groove.

* * * * *